United States Patent [19]

Mola

[11] 4,137,961

[45] Feb. 6, 1979

[54] CONTINUOUS CASTING OF METALS

[75] Inventor: Michel Mola, Paris, France

[73] Assignee: Creusot-Loire Vallourec, Paris, France

[21] Appl. No.: 759,658

[22] Filed: Jan. 17, 1977

[30] Foreign Application Priority Data

Jan. 20, 1976 [FR] France ..... 76 01411

[51] Int. Cl.[2] ..... B22D 27/02; B22D 27/08

[52] U.S. Cl. ..... 164/49; 164/83; 164/147; 164/437

[58] Field of Search ..... 164/49, 83, 84, 147, 164/250, 281, 82, 135, 136, 416, 437, 438, 439

[56] References Cited

U.S. PATENT DOCUMENTS

| | | | |
|---|---|---|---|
| 2,871,534 | 2/1959 | Wieland | 164/83 X |
| 2,944,310 | 7/1960 | Formann | 164/281 X |
| 3,268,959 | 8/1966 | Babel et al. | 164/84 |
| 3,905,417 | 9/1975 | Delassus | 164/147 |

FOREIGN PATENT DOCUMENTS

| | | | |
|---|---|---|---|
| 159771 | 11/1954 | Australia | 164/281 |
| 2163928 | 7/1972 | Fed. Rep. of Germany | 164/84 |
| 439602 | 12/1967 | Switzerland | 164/84 |
| 699156 | 1/1953 | United Kingdom | 164/83 |

OTHER PUBLICATIONS

"Magnetic Stirring: A New Way to Refine Metal Structure", by F. A. Crossley, "The Iron Age", Sep. 8, 1960, pp. 102–104.

*Primary Examiner*—Francis S. Husar
*Assistant Examiner*—K. Y. Lin
*Attorney, Agent, or Firm*—Brisebois & Kruger

[57] ABSTRACT

A method of continuously casting metals, inter alia steel or metals having similar characteristics, wherein liquid metal is poured into a mould having a circular cross-section and a substantially vertical axis, the mould wall is continuously cooled, the liquid steel is rotated in the mould by electromagnetic field windings placed in or level with the mould, and the solidified bar is continuously withdrawn at the bottom of the mould, in which the mould is supplied by a liquid steel stream which is inclined and eccentric with respect to the mould axis, so that when it strikes the surface of the liquid metal in the mould, it has a component substantially tangential to the geometrical circle extending through the point of impact and centered on the mould axis, thus producing a meniscus, the vertical distance between the base of the meniscus and the top end of the field windings being maintained at a sufficient value not to produce a substantial electromagnetic field at the meniscus, inter alia at its top part.

10 Claims, 2 Drawing Figures

CONTINUOUS CASTING OF METALS

Figure 1:
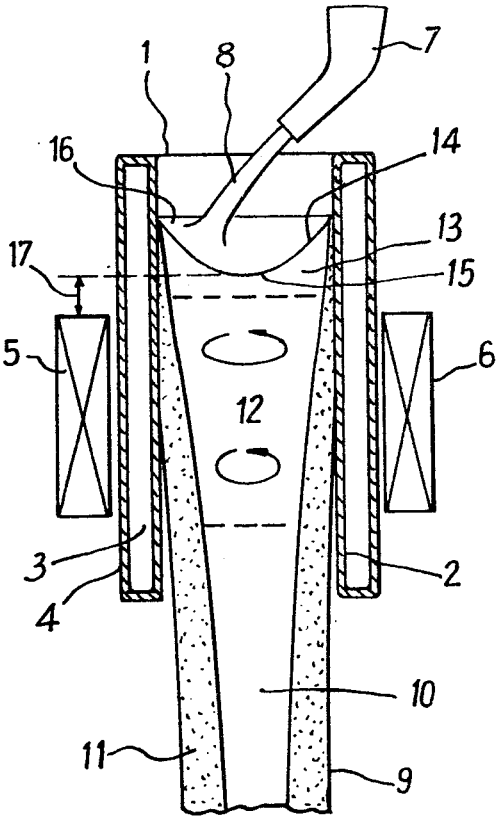

The invention relates to a method of continuously casting blanks or solid metal bars, inter alia of steel or of metals having similar characteristics. The invention also relates to a device for working the method and to bars or blanks obtained by the method.

It is known that, in order to ensure that blanks obtained by continuous casting of steel have good qualities both in the central part or core and at the exterior or skin, continuous casting along a substantially vertical axis is advisable, the cast liquid metal being rotated around the vertical axis.

Accordingly, a method has been developed wherein the liquid metal is rotated by rotating the mould around the vertical axis, which also means rotating the bar or blank which is withdrawn from below the mould.

This method is quite satisfactory, inter alia with regard to the qualities of the cast blanks, which can be directly used on drilling and rolling trains for manufacturing high-quality non-welded tubes as required e.g. in the petroleum industry.

In other methods of continuous casting which have been developed, the mould remains stationary and the steel in the mould is rotated by inductive electromagnetic fields coming from field windings disposed around or inside the mould.

In a method of this kind, the metal rotates only in the mould, or rather in a part thereof, which has certain disadvantages and means that the quality of the products cannot be as high as in the method in which the mould is rotated. However, electromagnetic rotation methods of the aforementioned kind have the advantage of not rotating the blank, which simplifies the construction of the casting tower and means that "curved" casting can be carried out, i.e. the solidifying blank is gradually bent into a horizontal direction.

An object of the invention is to obviate these disadvantages and improve the methods of continuous casting wherein the metal is rotated in the mould by electromagnetic induction, the aim of the invention being to improve the quality of the cast blank, facilitate the formation of a paraboloid meniscus at the surface of the liquid metal, increase the service life of the mould, facilitate the discharge of slag, increase the efficiency of the electromagnetic fields and also facilitate lubrication of the casting.

The invention relates to a method of continuously casting metals, inter alia steel or metals having similar characteristics, wherein liquid metal is poured into a mould having a circular cross-section and a substantially vertical axis, the mould wall is continuously cooled, the liquid steel is rotated in the mould by electromagnetic field windings placed in or level with the mould, and the solidified bar is continuously withdrawn at the bottom of the mould, characterised in that the mould is supplied by a liquid steel stream which is inclined and eccentric with respect to the mould axis, so that when it strikes the surface of the liquid metal in the mould, it has a component substantially tangential to the geometrical circle extending through the point of impact and centered on the mould axis, thus producing a meniscus, the vertical distance between the base of the meniscus and the top end of the field windings being maintained at a sufficient value not to produce a substantial electromagnetic field at the meniscus, inter alia at its top part.

Preferably the liquid metal stream is guided so that the point of impact is in the outer third of the inner radius of the mould; preferably the stream is inclined to the vertical by an angle of at least 30°.

The aforementioned vertical height can be maintained at a sufficient value by adjusting the stream flow rate so as to maintain the meniscus at a sufficient height in the mould. Preferably the vertical height is between 30 and 120 mm.

Preferably the mould is vertically oscillated at a conventional rhythm, so that the level in the mould varies. In that case, the aforementioned vertical height is such that, on average, the electromagnetic field generated by the field windings does not substantially influence the metallic substances above the base of the meniscus.

In a preferred embodiment, the mould does not rotate. Alternatively, the mould can be rotated, either continuously or intermittently or in reciprocating manner, preferably at low speed.

Preferably the speed of the metal stream is near the tangential speed of rotation of the metal at the meniscus.

Owing to these features, the invention provides a meniscus having more satisfactory properties; more particularly the metal is efficiently rotated not only in the central part of the mass of liquid metal but also at the periphery, inter alia at the upper part of the periphery where the solidified skin begins to form, so that the skin is formed in a particularly uniform manner, thus influencing the entire subsequent solidification at lower levels.

Since there is no substantial electromagnetic field at the mould periphery at the top of the surface region of liquid metal, the mould wall is not overheated at the place where the stream of hot metal arrives.

It is also found that, in this exposed region, the liquid metal efficiently wets the mould wall, whereas in the prior-art methods of electromagnetic rotation wetting is defective and slag may be entrained between the mould and the blank, thus adversely affecting the surface of the blank. Clearly, since the electromagnetic field is completely absorbed in the mass of liquid metal, there is an increase in the electromagnetic efficiency.

In addition, since the stream is eccentric and inclined, the supply means are positioned away from the mould axis and the slag can concentrate at the centre of the meniscus and be discharged by an operator.

The invention also relates to a device for working the method, comprising a continuous-casting mould having a circular cross-section and a cooled wall, means for supplying the mould, means for withdrawing the blank or solidified bar from the bottom of the mould and electro-magnetic induction means for rotating the metal in the mould, characterised in that the supply means comprise a refractory lip which is oriented above the mould so as to have a tangential component with respect to an internal circle of the mould and so as to be eccentric with respect to the mould axis in order to convey a stream by the method, the top part of the electromagnetic windings being at a sufficiently low vertical level to prevent the formation of electromagnetic fields in the top part of the mould.

Preferably the electromagnetic induction means are windings disposed inside the mould and directly cooled by the mould cooling liquid. Advantageously, the induction means supply a horizontal rotating field having a low frequency below 10 Hz, suitable for a conventional rotation speed between 30 and 120 rpm.

Advantageously, known means can be provided for vertically oscillating the mould.

The invention also relates to blanks made by the aforementioned method, the blanks being characterised inter alia in that the uniformity and purity of the core is comparable with that obtainable in good prior-art electromagnetic methods, and in that there is an improvement in the quality of the skin, which is practically free from cracks, folds and incrustations.

Figure 2:
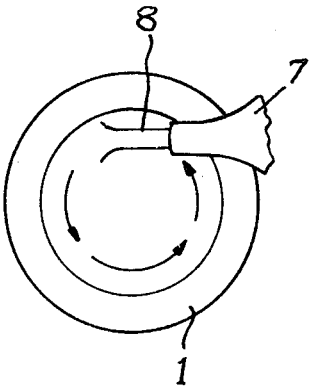

Other advantages and characteristics of the invention will be clear from the following description, which is given by way of non-limitative example and refers to the accompanying drawings in which:

FIG. 1 is a diagrammatic section through a device according to the invention, and FIG. 2 is a diagrammatic plan view of the device.

FIG. 1 is a diagrammatic axial section through a continuous casting installation according to the invention. The installation comprises a mould having a cylindrical or preferably slightly frusto-conical internal section, bounded by an internal wall 2 made e.g. of copper, behind which there is an annular space 3 in which a flow of water is produced by known means so as to cool wall 2. An outer wall 4 can e.g. be provided to bound the annular duct 3.

A number of field windings 5, 6 supplied with current at a frequency between 2 and 12 Hz are disposed, with a given angular spacing, around mould 1.

Of course, windings such as 5, 6 can be disposed in known manner inside the mould (contrary to the diagrammatic representation in FIG. 1), and cooled by the flow of water.

A supply lip 7 is disposed above the mould and is secured e.g. under a tundish or under a liquid steel ladle and is inclined and oriented so as to deliver a stream 8 which is inclined preferably at an angle between 30° and 60° to the vertical.

As shown in FIG. 2, the stream 8 has a tangential horizontal component with respect to a circle centred on the vertical axis of the mould and having a radius which is less than the internal radius of the mould and preferably of the order of $\frac{2}{3}$ thereof.

The liquid steel poured into the mould cools against wall 2 and a blank 9 having a circular cross-section comes out at the bottom of the mould and is continuously withdrawn, e.g. on rollers. Advantageously, the blank is cooled by a spray of water.

As can be seen, the blank contains a well of liquid metal 10 which narrows in proportion as the skin 11 thickens after forming at the top of the mould.

The electromagnetic fields produced by field windings such as 5, 6 produce rotation around the vertical geometrical axis of the mould in the well of liquid metal inside the mould. The rotation is localized in the region 12 bounded by broken lines, in which the resultant electromagnetic field is sufficiently strong.

However, in that region of the well which is above the region 12, the electromagnetic field is too weak to rotate the metal. Rotation, however, is produced by the orientation of the metal stream 8, which thus rotates the metal in the top region 13 and forms a parabolic meniscus 14, the lowest point of which is above the base and disposed at 15. Of course, in the region 16 at the top end of the meniscus, the electromagnetic field is practically zero and is thus not likely to overheat wall 2 at the corresponding level.

Alternatively, of course, according to the invention, the electromagnetic fields could be sufficiently intense to rotate the metal in the meniscus region but sufficiently weak not to heat the mould at the top 16 of the meniscus.

In practice, according to the invention, this is achieved by varying the vertical height 17 between the top of the field windings 5, 6 and the bottom 15 of the meniscus.

By way of example, the method according to the invention was applied to the continuous casting of steel bars 130 mm in diameter at a steel flow rate of 12 tonnes per hour, using a mould having a total height of 500 mm, a field winding height of 400 mm and a distance 17 of 50 mm. The inclination of the stream to the horizontal was 55°.

The resulting bar has excellent qualities at the centre and adequate skin quality, mainly because the rotation produced by the inclined stream of liquid metal results in efficient wetting of the mould wall and prevents particles of slag being entrained between the wall and the metal skin.

What we claim is:

1. In a method of continuously casting metal like steel, wherein the liquid metal is poured into a mould having a circular cross section and a substantially vertical axis, the wall of the mould is continuously cooled, the liquid metal is rotated in the mould by an electromagnetic field, and the solidified bar is continuously withdrawn at the bottom of the mould, the improvement comprising, the steps of, supplying the mould with a liquid metal stream which is inclined and eccentric with respect to the mould axis, directing said stream so that when it strikes the surface of the liquid metal in the mould, it has a component substantially tangential to a geometrical circle extending through the point of impact and centered on the mould axis, thus producing at the surface of the liquid metal a meniscus which causes a uniform peripheral skin to form at the top of the bar, and simultaneously rotating the liquid metal in the mould in the same direction as said tangential component by directing the electromagnetic field into the liquid metal below said meniscus without directing any substantial electromagnetic field into the metal of the meniscus or the skin forming at the top of the mould to thereby improve wetting of the surface of the mould by the liquid metal at the region of the meniscus.

2. The method according to claim 1, wherein, said step of directing said metal stream further comprises directing the stream of liquid metal to a point of impact in the outer third of the inner radius of the mould.

3. A method according to claim 1 in which said step of supplying the mould with a liquid metal stream comprises supplying the stream inclined to the vertical at an angle of at least 30°.

4. A method according to claim 1 wherein, said step of rotating the liquid metal in the mould with an electromagnetic field comprises supplying the electromagnetic field with an electromagnet having the upper end of its field windings at a location between 30 and 120 mm below the meniscus.

5. A method according to claim 1 further comprising oscillating the mould vertically while supplying the mould with liquid metal.

6. A method according to claim 1 further comprising rotating the mould while supplying the mould with liquid metal.

7. A method according to claim 1 wherein said step of supplying the mould with a liquid metal stream further comprises supplying the stream at a speed substantially equal to the tangential speed of rotation of the metal at the level of the meniscus.

8. Apparatus for continuous casting comprising, in combination, a continuous casting circular mould having refractory walls defining an inner surface, and a generally vertical axis, supply means for supplying the mould with liquid metal in a stream directed tangentially of the mould and inwardly of the inner surface of the mould and into a meniscus of molten metal at an upper portion of the mould, said supply means maintaining said meniscus at a predetermined level in said upper portion of the mould, electromagnetic induction means for rotating the liquid metal in the mould below said meniscus in the same direction as said tangentially directed stream, said electromagnetic induction means comprising electromagnetic windings spaced below said upper portion of the mould by a distance sufficient to substantially prevent the formation of electromagnetic fields in the upper portion of the mould containing the meniscus of liquid metal to thereby improve wetting of the surface of the mould by the liquid metal at the region of the meniscus, and mould coolimg means for cooling said mould.

9. Apparatus according to claim 8 wherein said electromagnetic windings are adjacent said mould and are cooled by said mould cooling means.

10. Apparatus according to claim 8 further comprising means for energizing said field windings at a low frequency in the range of 4–12Hz.

* * * * *